United States Patent [19]

Kanuma

[11] 3,967,087

[45] June 29, 1976

[54] SEALING STRUCTURES FOR THE OUTPUT PORTIONS OF MAGNETRONS

[75] Inventor: Yoji Kanuma, Mobara, Japan

[73] Assignee: Hitachi, Ltd., Tokyo, Japan

[22] Filed: Oct. 8, 1974

[21] Appl. No.: 513,097

[30] Foreign Application Priority Data

Oct. 11, 1973 Japan ..... 48-117475[U]

[52] U.S. Cl. ..... 219/10.55 B; 219/10.55 D; 315/39.51

[51] Int. Cl.[2] ..... H05B 9/06

[58] Field of Search ..... 219/10.55 B, 10.55 D; 315/39, 39.51, 39.53; 174/35

[56] References Cited

UNITED STATES PATENTS

| | | | |
|---|---|---|---|
| 2,910,614 | 10/1959 | Boudley | 315/39 X |
| 3,172,987 | 3/1965 | Fitzmayer | 219/10.55 B |
| 3,493,810 | 2/1970 | Valles | 315/39.53 |
| 3,629,538 | 12/1971 | Suzuki | 219/10.55 B |
| 3,794,879 | 2/1974 | Edwards | 219/10.55 B |

*Primary Examiner*—Bruce A. Reynolds
*Attorney, Agent, or Firm*—Charles E. Pfund

[57] ABSTRACT

In the sealing structure for the output portion of a magnetron of the type wherein the output portion including an antenna is sealed to the magnetron support, the support is provided with an opening at the center which is surrounded by an annular bent portion. The bent portion is provided with axial slits for resiliently receiving a sealing ring at the base of the antenna.

5 Claims, 6 Drawing Figures

SEALING STRUCTURES FOR THE OUTPUT PORTIONS OF MAGNETRONS

BACKGROUND OF THE INVENTION

This invention relates to an output sealing structure of a magnetron, and more particularly to an improved joint between the magnetron and a waveguide which forms a portion of a microwave oven, for example, or a support of the magnetron.

Such a magnetron is used in a microwave oven, for example, as diagrammatically shown in FIG. 1. As shown, the microwave oven 11 comprises a cooking chamber 14 for accommodating a foodstuff 13 to be cooked and a door 12. An opening 15 is formed through the upper wall of the cooking chamber 14 for admitting the microwave from the output 21 of a magnetron 20 through a waveguide 16, thereby cooking the foodstuff by dielectric heating.

In such an oven, it is necessary to transmit all microwaves radiated from the output 21 through the waveguide 16, but if the seal at the joint between the output 21 and the waveguide 16 were not perfect a portion of the microwave would leak to the outside thus decreasing the efficiency, injuring the user and causing spark across the gap at the joint.

To overcome these difficulties, the seal at the output 21 of the magnetron has been constructed as shown in FIG. 2 which shows a magnetron 20 of the outside magnet type. The magnetron 20 illustrated comprises upper and lower rectangular yokes 25 and 26, cylindrical permanent magnets 27 and 28 between opposite ends of the yokes, an anode cylinder 30 and sector shaped ducts 31 and 32 (the latter is not shown in FIG. 2) projecting in the radial direction from the anode cylinder 30. At the center of the yoke 25 is formed an opening 33 through which the output portion 21 of the magnetron comprising an antenna 34 and a ceramic insulator 35 extends to the outside. Similar opening (not shown) is also provided at the center of the yoke 26 for passing a cathode structure including heater terminals, cathode stem, etc.

As shown, yoke 25 is connected directly to a flange 42 and waveguide 16 by means of bolts 40 and 41. The flange 42 is used as a support for the magnetron and is provided with a circular opening 44 at its center having an edge 45 bent toward the yoke 25. The waveguide 16 is secured to the flange 42 to surround the opening 44. The pole pieces 45′ project at the base of the output portion 21 and an annular metal gasket 26 surrounds the pole pieces. In this example, pole pieces 45′ and gasket 46 are contained in the opening 33 of yoke 25. The inturned edge 45 and the gasket 46 have substantially the same diameter so that the inturned edge 45 is caused to urge against the gasket when the yoke 25 is connected to the flange 42 and the waveguide 16 by bolts 40 and 41 whereby the pole pieces 45′, gasket 46, flange 42 and waveguide 16 are electrically interconnected and the gaps between these elements are sealed to prevent leakage of the microwave.

With such sealing structure, however, due to oxidation of the surface of the gasket 46, or decrease in the resiliency thereof, the electrical and mechanical contacts between the inturned edge 45 and the gasket 46 become imperfect thus causing increase in the contact resistance or leakage of the microwave or electric spark.

Furthermore, the centering of the waveguide 16 and the magnetron can be performed only by suitable selection of relative position of openings 47 and 48 (not shown) and the bolts 40 and 41. As a consequence, it is necessary to make the diameter of the openings 47 and 48 to be minimum so as to minimize the clearance between the inner surfaces thereof and the bolts 40 and 41. Further, the positions of the bolts should be accurately determined thus requiring careful machining and assembling.

SUMMARY OF THE INVENTION

Accordingly, it is an object of this invention to provide an improved sealing structure for the output portion of a magnetron which is resistant to aging.

Another object of this invention is to provide an improved sealing structure for the output portion of a magnetron which is simple to machine and assemble.

According to this invention, there is provided a sealing structure of the output of a magnetron of the type wherein the output portion including an antenna for supplying a microwave to a load is sealed to the support of the magnetron, characterized in that there are provided an annular bent portion about an opening at the center of the support, said bent portion being provided with a plurality of axial slits, and a sealing ring at the base of the antenna, said sealing ring being fit with electrical and mechanical contact in the annular bent portion.

BRIEF DESCRIPTION OF THE DRAWINGS

In the accompanying drawings

DETAILED DESCRIPTION OF THE PREFERRED EMBODIMENTS

Figure 1:
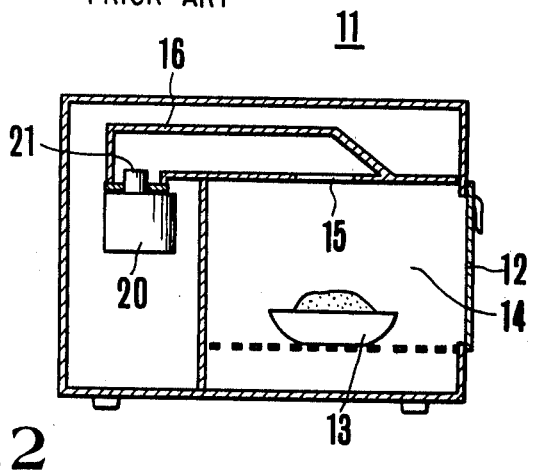
FIG.1 PRIOR ART
FIG. 1 shows a diagrammatic sectional view of a microwave oven to which the invention is applicable.
Figure 2:
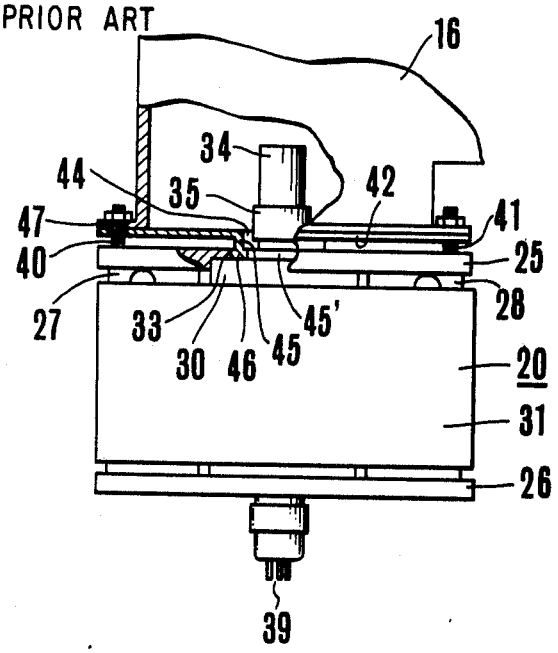
FIG.2 PRIOR ART
FIG. 2 is a side view, partly in section, of a conventional sealing structure for the output portion of an outer magnet type magnetron.
Figure 3:
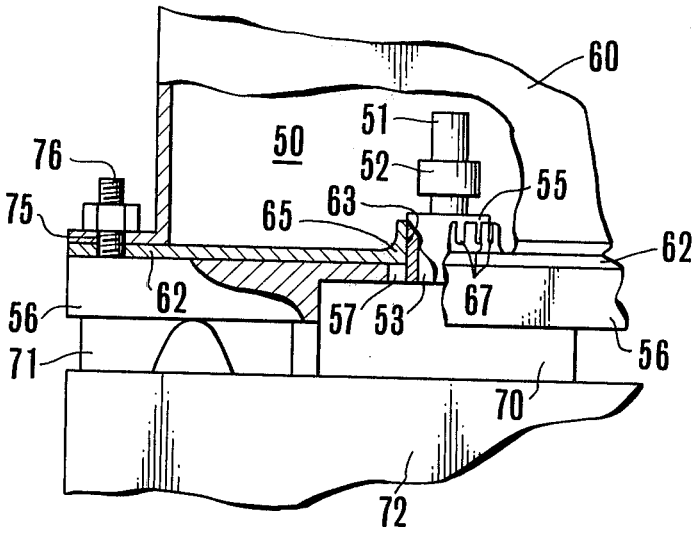
FIG. 3 is a side view, partly in section, of a sealing structure embodying the invention for the output portion of a magnetron.

In a preferred embodiment of this invention shown in FIG. 3, the output portion 50 of a magnetron comprises an antenna 51 and a ceramic insulator 52. Pole pieces 53 of the magnets project toward the base of the output portion. The construction described above is identical to that shown in FIG. 2. According to this invention, the pole pieces abut against the inner periphery of a sealing ring 55. The sealing ring 55 is made of iron kovar or copper and positioned in an opening 57 (corresponding to the opening 33 shown in FIG. 2) at the center of a yoke 56. The sealing ring 55 extends upwardly above the upper surface of the yoke 56. The length of the portion of the sealing ring 55 projecting above the yoke 56 is the same or larger than the axial length of the bent up portion to be described later. The flange 62 or support of the magnetron which connects the output portion 50 of the magnetron to a waveguide 60 is made of aluminum or stainless steel and is provided with a central opening 63 in the same manner as the flange 42 shown in FIG. 2. However, different from the construction shown in FIG. 2, the edge 65 of the opening 63 is bent upwardly toward the waveguide 60. This bent up portion 65 is provided with a plurality of circumferentially spaced apart axial slits 67 for the purpose of imparting resiliency in the radial direction to the bent up portion 65. The diameter of the opening surrounded by the bent up edge 65 is made to be slightly smaller than the outer diameter of the sealing ring 55 secured to the output portion 50 of the magnetron. As a consequence, when the sealing ring 55 is fit in the opening 63, sealing ring 55 is jointed with electrical and mechanical contact to the flange 62. In FIG. 3, 70 shows the anode cylinder of the magnetron, 71 a permanent magnet and 72 a cooling duct.

With this construction, the joint between the waveguide 60 and the output portion 50 of the magnetron is in electrical and mechanical contact condition. More particularly, the bent up portion 65 is made to be resilient in the radial direction due to the provision of the slits 67, and since the diameter of the bent up portion 65 is slightly smaller than the outer diameter of the sealing ring 55, they are fitted snugly. Thus, it is possible to connect the waveguide 60 to the magnetron with good electrical and mechanical contact without using any gasket as in the prior art.

Figure 4:
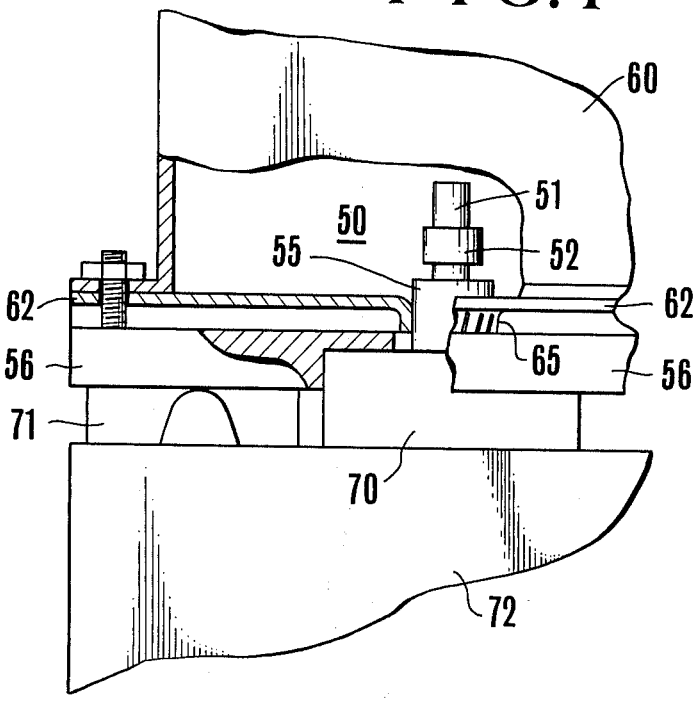
FIG. 4 is a side view, partly in section, showing a modified embodiment of this invention.

Further, with the sealing structure of this embodiment accurate centering of the magnetron and the waveguide can be assured by fitting the sealing ring 55 into the bent up portion 65, so that it is not necessary to accurately position the opening 75 provided through the flange of the waveguide and to machine the bolt 76 received in the opening 75. Instead of bending the edge of the opening 63 in the upward direction toward the inside of the waveguide it may be bent in the downward direction if a space is available, as shown in FIG. 4. In case of bending edge of the opening 63 downwardly, it is preferable to round the shoulder portion of sealing ring 55 which is coupled to said bent edge of opening in order to make their engagement easy.

Figure 5:
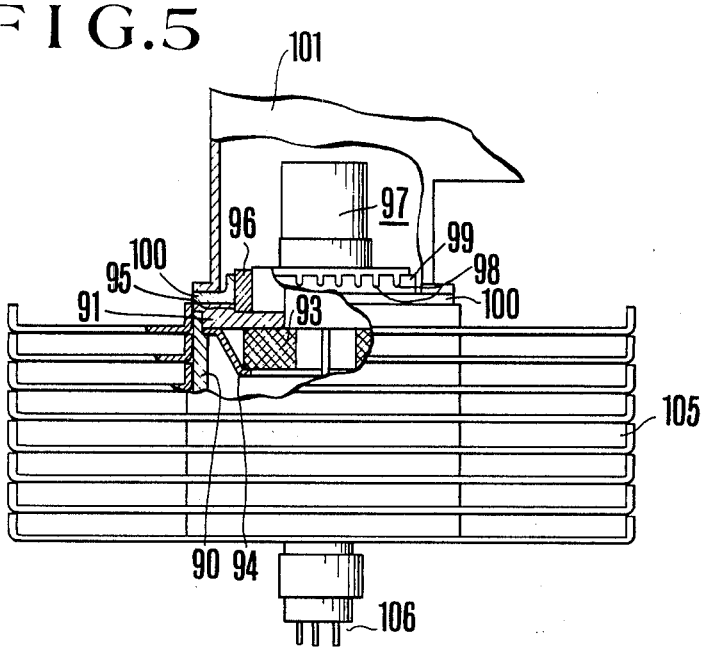
FIG. 5 and FIG. 6 are a sectional view of other embodiments of this invention as applied to an inner magnet type magnetron.

In another modification shown in FIG. 5, the invention is shown as applied to an inner magnet type magnetron. In this embodiment, a yoke 91 constituting an air tight sealing wall is mounted on the anode cylinder 90 of the magnetron for containing an annular permanent magnet 93 which is supported on the inner side of the yoke 91 by means of conical frustum support 94. A shallow circular recess 95 is formed on the upper side of the yoke 91 to fix a sealing ring 96 therein by means of a pertinent fixing method such as brazing method. The output portion 97 of the magnetron is received in the sealing ring 96. A support 100 for the magnetron is provided with a bent up portion 99 formed with a plurality of axial slits 98 to receive the sealing ring 96. The waveguide 101 is secured to the upper side of the support in the same manner as in the previous embodiments. 105 shows cooling fins, and 106 a cathode structure. This embodiment provides the same advantageous effects as the previous embodiments.

Figure 6:
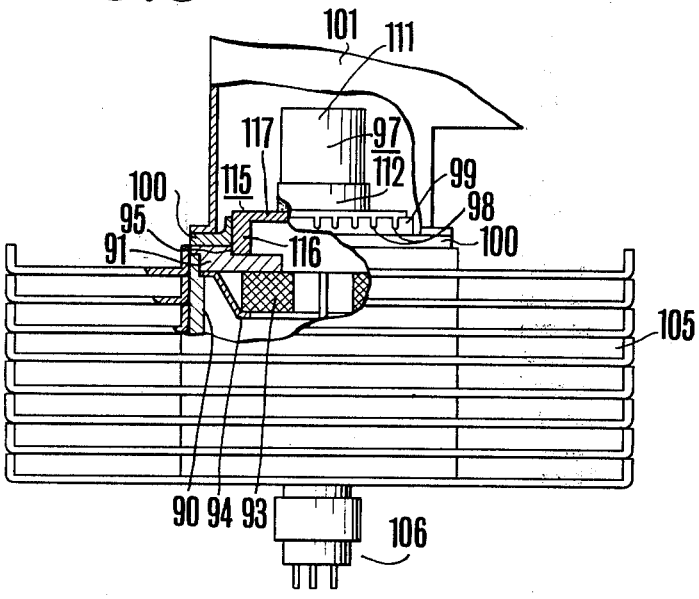

FIG. 6 is another embodiment derived from one shown in FIG. 5. In this embodiment, the sealing ring 96 is eliminated by means of improving the structure of the output portion 97 of magnetron, in which the structure includes a member having an opening at the base of antenna, said opening having a diameter larger than the outer diameter of antenna 111 and ceramic insulator 112. More detailedly, the member is a cylindrical pedestral 115 having an approximately equal inner diameter to that of the ceramic insulator 112. This pedestral 115 is constituted with the ceramic insulator 112, the cylinder 116 having an inner diameter larger than the outer diameter of said ceramic insulator 112, and a plate member 117 having an opening at the central area thereof, said opening having approximately equal diameter to the inner diameter of said ceramic insulator, and further these constituents are integrally formed to establish this pedestal. Namely, the end portion of the cylinder 116 is fixed by means of brazing in the circular plate shaped recess 95 which is provided on the upper surface of the yoke 91. The ceramic insulator 112 is secured on the opening of the plate member 117. Then the cylinder 116 of this improved output portion of magnetron is fixed with electrical and mechanical contact to the support 100. It is easily seen that the same effect as obtained with the embodiment shown in FIG. 5 can be attained by this improvement.

It should be understood that the invention is also applicable to other types of the output portion of the magnetron.

Although in the foregoing embodiments, the microwave oven has been connected to the magnetron support through a waveguide, the magnetron support can be directly connected to the microwave oven. Further, it is also possible to use the magnetron support as a portion of the oven.

It should also be understood that any other application of dielectric heating than a microwave oven may be coupled to the magnetron. The novel sealing structure of this invention is effective regardless of the type of the load.

Thus, the invention provides an improved sealing structure in which the magnetron support is provided with an inturning annular edge formed with axial slits for electrically and mechanically connecting the load of the magnetron, such as a microwave oven or a waveguide to the output portion of the magnetron. The sealing effect of such structure will not be degraded by aging. Moreover, such sealing structure assures accurate centering as well as ready assembly of the structure.

What is claimed is:

1. In the sealing structure for the output portion of a magnetron of the type wherein the output portion is sealed to a support for the magnetron, said output portion including an antenna for supplying microwave energy to a load and an insulator for insulating said antenna from a base portion for said antenna constituting a part of the magnetron, the improvement wherein said support for the magnetron comprises a plate member with a annular bent portion formed about an opening at the central area of said plate member, said bent portion being provided with a plurality of axial slits, said base portion for said antenna comprising a pedestal which includes a cylindrical portion of a larger diameter than said insulator and a second plate member having an opening of a diameter approximately equal to the inner diameter of said insulator, the upper end of said cylindrical portion being integrally fixed to said second plate member, the lower end of said cylindrical portion being fixed to an element adjacent to the output portion of the magnetron, said base portion for said antenna being in electrical and mechanical contact with said annular bent portion.

2. The sealing structure according to claim 1 wherein said bent portion of the magnetron support is bent toward the body of the magnetron.

3. The sealing structure acccording to claim 2 wherein the shoulder of said pedestal adapted to engage the bent portion is rounded.

4. The sealing structure according to claim 1 wherein said bent portion of the magnetron support is bent in a direction away from the body of the magnetron.

5. The sealing structure according to claim 1 wherein a waveguide leading to a cooking chamber of a microwave oven is connected to said support.

* * * * *